US007217197B2

(12) United States Patent
Park

(10) Patent No.: US 7,217,197 B2
(45) Date of Patent: May 15, 2007

(54) GOLF SWING TRAINING DEVICE

(76) Inventor: Glenn Park, 6965 Abbottswood Dr., Rancho Palos Verdes, CA (US) 90275-3021

( * ) Notice: Subject to any disclaimer, the term of this patent is extended or adjusted under 35 U.S.C. 154(b) by 339 days.

(21) Appl. No.: 10/697,057

(22) Filed: Oct. 30, 2003

(65) Prior Publication Data

US 2004/0214649 A1 Oct. 28, 2004

Related U.S. Application Data

(63) Continuation-in-part of application No. 10/425,523, filed on Apr. 28, 2003, now abandoned.

(51) Int. Cl.
*A63B 69/36* (2006.01)

(52) U.S. Cl. ..... 473/221; 473/219

(58) Field of Classification Search ..... None
See application file for complete search history.

(56) References Cited

U.S. PATENT DOCUMENTS 4,090,711 A * 5/1978 Amato ..... 473/232
5,082,281 A * 1/1992 Berghofer ..... 473/207
5,082,283 A * 1/1992 Conley et al. ..... 473/234
5,259,620 A * 11/1993 Marocco ..... 473/224
5,558,519 A * 9/1996 Sabowitz ..... 434/247
5,743,807 A * 4/1998 Bendo et al. ..... 473/234
5,959,230 A * 9/1999 Fulford ..... 84/464 R
6,413,167 B1 * 7/2002 Burke ..... 473/224
6,547,434 B1 * 4/2003 DeRosa ..... 368/89
2001/0031684 A1 * 10/2001 Ervin ..... 482/14
2002/0077189 A1 * 6/2002 Tuer et al. ..... 473/151
2002/0160848 A1 * 10/2002 Burke ..... 473/233

* cited by examiner

*Primary Examiner*—Mark Sager
(74) *Attorney, Agent, or Firm*—Robert R. Meads

(57) ABSTRACT

A small lightweight golfers' aide comprising low-level high frequency physical vibration generator within a housing for transmitting the vibrations to a golfer as physical vibration patterns indicative of a preferred swing tempo for the golfer.

11 Claims, 8 Drawing Sheets

GOLF SWING TRAINING DEVICE

RELATED APPLICATION

This is a continuation-in-part of U.S. patent application Ser. No. 10/425,523 filed Apr. 28, 2003 now abandoned.

FIELD OF INVENTION

The present invention relates to apparatus for training golfers to improve and maintain the tempo of their golf club swing and, more particularly, to an improved golf swing-training device for enabling golfers to maintain a preferred tempo for their golf club swings under playing as well as practice conditions.

BACKGROUND OF INVENTION

It has been realized for some time that consistency in the tempo of a golfer's swing under varying game conditions is essential to improvement in a golfers overall game and in reducing a golfer's scores. In the past, audio and visual training aides have been developed to improve the consistency of the tempo of a golfer's swing by providing audible and/or visual signals that guide the golfer during the back and down swings of his or her golf club. Unfortunately, such training aides are suitable for use only under controlled practice conditions. Under game conditions, however, a golfer is to keep his or her eyes on the ball as the ball is addressed and during the back swing, upper pause and downswing of the golf club to insure that the club head properly strikes the ball. This requirement renders prior visual signal training practically useless under game conditions.

Prior audio-signal training aides also suffer several drawbacks. Those systems that require a loud speaker to generate a sound signal for the golfer interfere with the golfers mobility on the course and are distracting to other golfers. Those systems which utilize a head set connected by an electrical lead to an audio source often interfere with the swing pattern of the golfer wearing the training aide and therefore distract rather than assist the golfer during game conditions. In fact, any audio headset or earpiece is likely to function as a distraction to the golfer while swinging his or her club.

The following U.S. patents describe such prior art visual and audio training aides: U.S. Pat. Nos. 4,577,868; 4,583,738; 5,040,790; 5,082,281; 5,558,519; 5,743,807; 5,871,406; 5,984,799; 6,040,517; 6,179,723; and 6,517,352.

Recently, a shock device has been proposed for sending a periodic electrical shock signal to the wrist of a golfer as a means of prompting the golfer during the swinging of his or her golf club. Japanese publication JP3-128073 describes such a system. Certainly, the periodic shocking of a golfer is counter-productive to the creating of a smooth consistent golf club swing.

SUMMARY OF INVENTION

The present invention comprises a small, lightweight, electromechanical golfers' aide for generating relatively high frequency low-level physical vibration patterns. The aide is contained in a housing that transmits the physical vibrations to the golfer.

In a first embodiment of the golfers' aide, the housing comprises a case about the size of a telephonic pager attachable to the body of the golfer as by a belt or pocket clip or other suitable means.

In a second embodiment of the golfers' aide, the housing comprises a cavity and/or tubular case in the grip portion of a golf club. Such as case may be removable from one club to another or may be carried in the hand or pocket of the golfer.

In all embodiments, upon command, the golfers' aide generates the low-level physical vibration patterns. The physical vibration patterns may be factory set or of user adjustable time duration and are physically sensed by the golfer as being indicative of a preferred golf club swing tempo for the golfer comprising a preferred back swing duration, upper club pause time, and preferred club downswing and follow through duration.

In the first preferred embodiment of the golfers' aide, the vibration pattern time durations may be programmable by the golfer to his or her preference taking into account the golfers' physical stature, the size and type of golf club and the playing conditions of the course being or to be played. Alternatively, the first embodiment of the golfers' aide may include a control switch for directing high frequency electrical signals which otherwise would activate the physical vibrations to a sound transducer for generating high frequency sound patterns corresponding to the physical vibration patterns indicative of the preferred swing tempo for the golfer.

DETAILED DESCRIPTION OF INVENTION

Figure 1C:
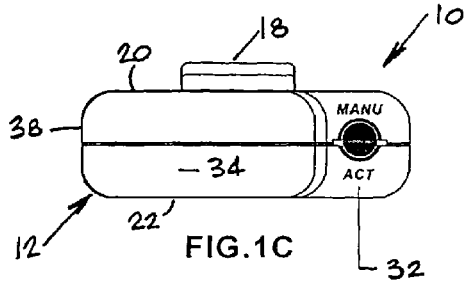
FIGS. 1A–1D are front, right side, and top and left side views of the case housing the golfers' aide in a first embodiment of the present invention.
Figure 1D:
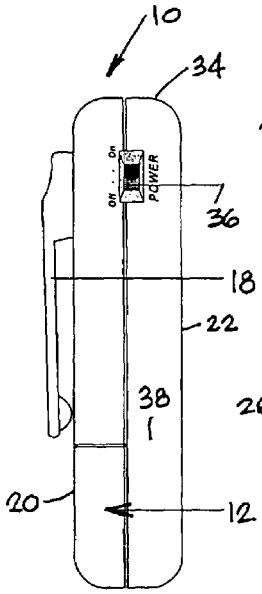
Figure 1A:
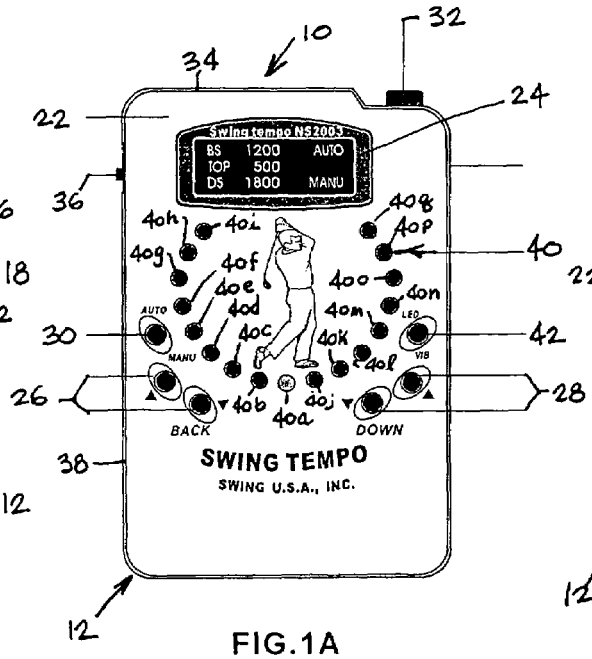
Figure 1B:
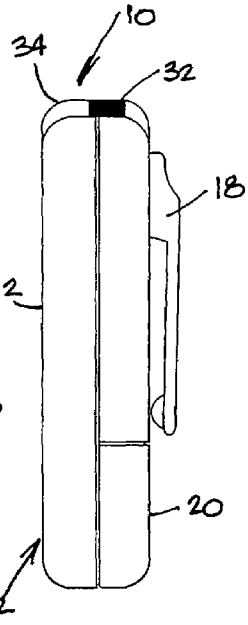
Figure 2:
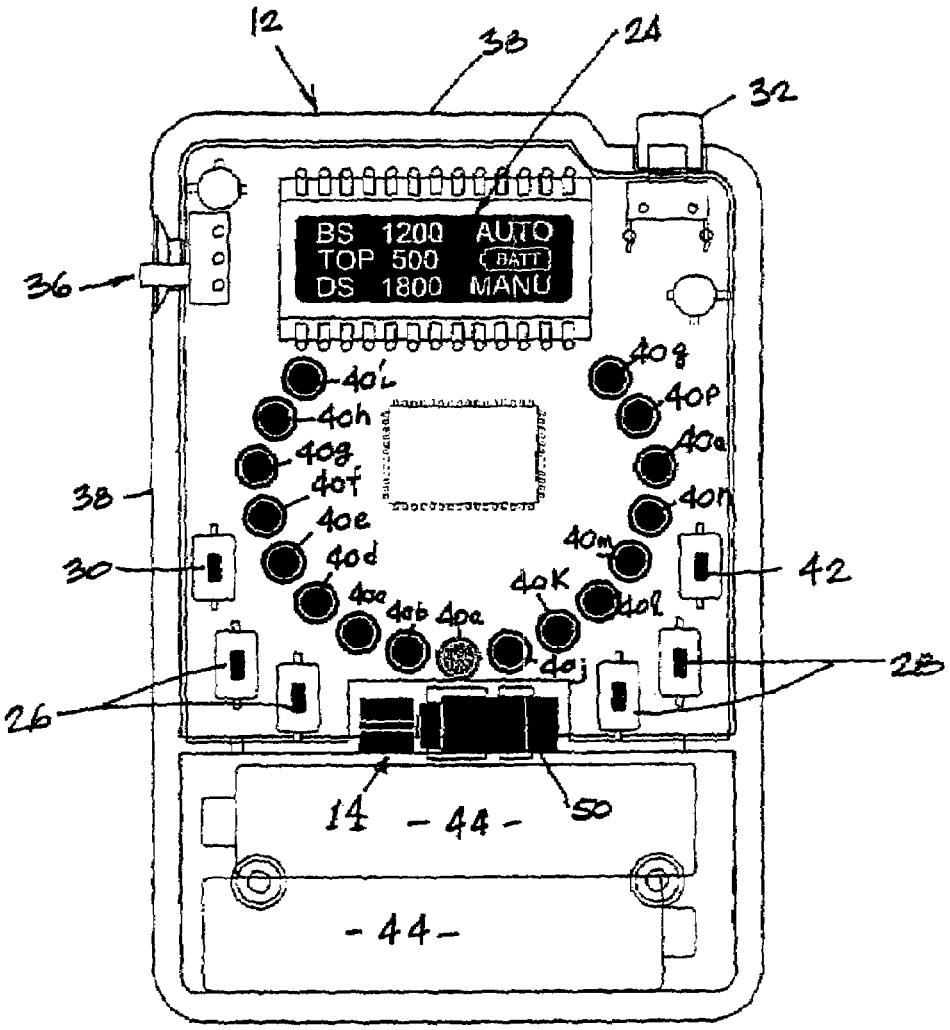
FIG. 2 is an enlarged front view of the case of FIG. 1 with the front cover removed to show the layout of circuit components for the golfers' aide of FIG. 1.

In the drawings, the number 10 depicts the golfers' aide of the present invention. In FIGS. 1 and 2, the golfers' aide 10 comprises a small, lightweight hand-holdable case 12 attachable to the body of a golfer. The case 12 houses means 14 for generating low level physical vibration and/or light patterns as well as user selectable means 16 for programming the operation of the means 14 to generate either low level physical vibration or light patterns of adjustable time durations indicative of a users' golf club swing tempo.

As described herein, a golf club swing starts with a golfer addressing a ball with the head of a golf club and comprises a golf club back swing to an upper club pause position followed by a club downswing and follow through during which the ball is hit by the head of the golf club.

As will be described hereinafter, with the golfers' aide 10 comprising a first embodiment of the present invention, a golfer is able to preset or program real time the operation of his or her golfers aide 10 to generate physical vibration and/or light patterns indicative of a number of different swing tempos each of which comprise a user selected back swing time duration, upper pause time and down swing and follow through time duration that the golfer considers as being preferred for the golfers physical stature, type and size of golf club and golf course conditions presented to the golfer. By virtue of the low level vibration patterns generated by the golfers aide 10 and physically sensed by the golfer, the golfer is guided to conform the tempo of his or her golf club swing to the preferred back swing, upper pause time and downswing time durations he or she has selected for the preferred tempo of the golf club swing.

More particularly, as depicted in FIGS. 1A–1D, the case 12 is formed of a lightweight plastic material and is about the size of a common telephonic pager. The case is attachable to a golfer as by a belt or pocket clip 18 secured to a backside 20 of the case.

A front side 22 of the case 12 houses or supports a conventional LCD display 24 upon which the different user programmed time durations for the golfers' back swing (BS), top of back swing pause (TOP) and downswing (DS) are selectively displayed. By way of example, the users selected time durations for the back swing BS, pause time TOP and down swing DS shown in FIG. 1A are 1200, 500 and 1800 units of time respectively. By way of example only, such unit representations may correspond to vibration durations of 1.2, 0.5 and 1.8 seconds respectively. These time durations are controllable by the golfer simply by pressing the "up" and "down" directed arrow buttons of the back swing ("BACK") and down swing ("DOWN") momentary switches 26 and 28 on the front side 22 of the case 12. For example, if the golfer, considering his or her physical stature, golf club selection and/or golf course condition, believes that the golf club swing tempo should be modified to change the back swing time duration to 1300 units of time, he or she simply presses the "up" indicating button of the BACK momentary switch 26 to effect an increase in the displayed back swing time duration to "1300". Similarly, if the golfer believes that the preferred swing tempo should be changed to reflect a down swing time duration of only 1700 units of time, he or she simply presses the "down" indicating button of the DOWN momentary switch 28 to effect a reduction of displayed down swing time to "1700". In these regards, the setting of the golfers' aide 10 is much like the setting of a conventional digital clock or video channel or volume selector.

As shown in FIG. 1A, the display 24 also indicates whether the golfers' aide 10 is in either a manual ("MANU") or automatic ("AUTO") mode of operation. Such modes of operation are controlled by the golfer touching the button of an "AUTO"/"MANU" momentary switch 30 on the front side 22 of the case 12. In the manual mode of operation, the golfers' aide 10 may require manual operation of a "MANU ACT" switch 32 on a top side 34 of the case above the display 24 to initiate each tempo swing control of the golfers' aide 10 as previously described. In the automatic mode of operation, the golfers' aide recycles its swing tempo operation as described above until the "AUTO"/"MANU" switch 32 is changed to a manual mode of operation or until the golfers' aide is turned off by a pressing of a "On-Off POWER" switch 36 on the upper left side 38 of the case 12 to an "Off" condition.

As shown in FIG. 1A, the front side 22 of the case 12 also supports a semicircular array of seventeen light emitting diodes (LEDs) 40 which may be energized to provide a visual display of the swing tempo selected by the golfer using the switches 26 and 28 as described above. The energizing of the LEDs is under control of a "LED"/"VIB" momentary switch 42 on the front side 22 of the case 12. By pressing the switch 42 the golfer may select between a visual mode ("LED") and a vibratory mode ("VIB") of operation for the golfers' aide 10.

In the LED mode of operation, the LEDs will be energized in a sequence corresponding to the swing tempo programmed by the golfer as previously described. For example, for the swing tempo displayed by the LCD display 24 in FIG. 1A, when the power switch 36 is activated with the switch 42 in the LED position, the LEDs will light in the timing sequence indicated in FIG. 4. That is, after a short time interval indicated by the time T1, the lowermost LED 40*a* will light and stay lit for the time T2 signaling to the golfer that he or she should be addressing the ball with the head of a golf club. After a time indicated by T3, the programmed back swing duration will commence with the LEDs 40*b–i* lighting in timed succession indicative of the duration of the back swing T4. The LED 40*i* will remain lit for the time T5 indicative of the upper pause time for the golf club. Following T5, the LEDs will then light in a reverse sequence from LED 40*i* to LED 40*a* and continuing from LED 40*j* to LED 40*q* during the time T6 indicative of the down swing and golf club follow through time duration. If the golfers' aide is in its manual mode of operation as previously described, once the LEDs have completed the above-described cycle of operation, the LEDs will turn off awaiting a restart by activation of the manual actuation switch 32. If the golfers' aide 10 is in its automatic mode of operation as previously described, the foregoing LED operation will continue to repeat until the manual/automatic switch 30 is changed to the manual mode or the power on/off switch 36 is deactivated.

As described above, the LED mode of operation of the golfers' aide 10 may be particularly useful as a visual support to the golfer in selecting the settings for or programming operation of the golfers' aide. In that regard, the LEDs operate to provide a timed sequence of light operation visually indicative of the swing tempo which the golfer is setting as he or she is programming the golfers' aide 10.

Figure 4:
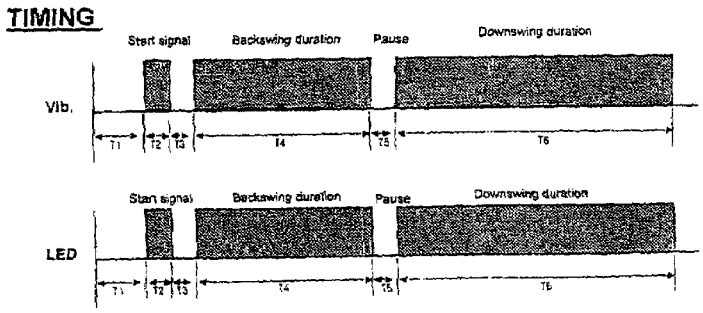
FIG. 4 are timing diagrams of one of the vibration and light patterns generated by the golfers' aide of FIG. 3 indicative a golfers' preferred golf swing tempo including preferred back swing, upper club pause and downswing time durations.

When the LED/VIB switch 42 is in its VIB mode, the golfers' aide 10 is placed in a vibratory mode of operation wherein the means 14 contained within the case 12 produces low level physical vibration patterns of user selectable time durations such as illustrated in FIG. 4. The physical vibrations produced by the means 14 are of a low level, for example, somewhat greater than the level of physical vibrations generated by the motor in a conventional electric razor. The golfer physically senses such vibrations as timing patterns for the swing tempo of his or her golf club including back swing, upper pause and downswing of a golf club.

More particularly, for the timing sequence of physical vibrations illustrated in FIG. 4, after a short time interval indicated by the time T1, a first series of physical vibrations of time duration T2 is generated by the means 14 signaling to the golfer that he or she should be addressing the ball with the head of a golf club. After a time indicated by T3, a time duration programmed series of physical vibrations is generated by the means 14 indicative of a back swing duration T4. At the end of the back swing indicative vibrations, physical vibrations will cease for the time period T5 indicative of the upper pause time for the golf club. Following T5, the means 14 will resume generation of physical vibrations for the time T6 indicative of the down swing and golf club follow through time duration. If the golfers' aide is in its manual mode of operation as previously described, the means 14 will then remain in a dormant state awaiting a restart by activation of the manual actuation switch 32. If the golfers' aide 10 is in its automatic mode of operation as previously described, the foregoing vibration operation will continue to repeat until the manual/automatic switch 30 is changed to its manual mode or the power on/off switch 36 is deactivated.

Figure 3:
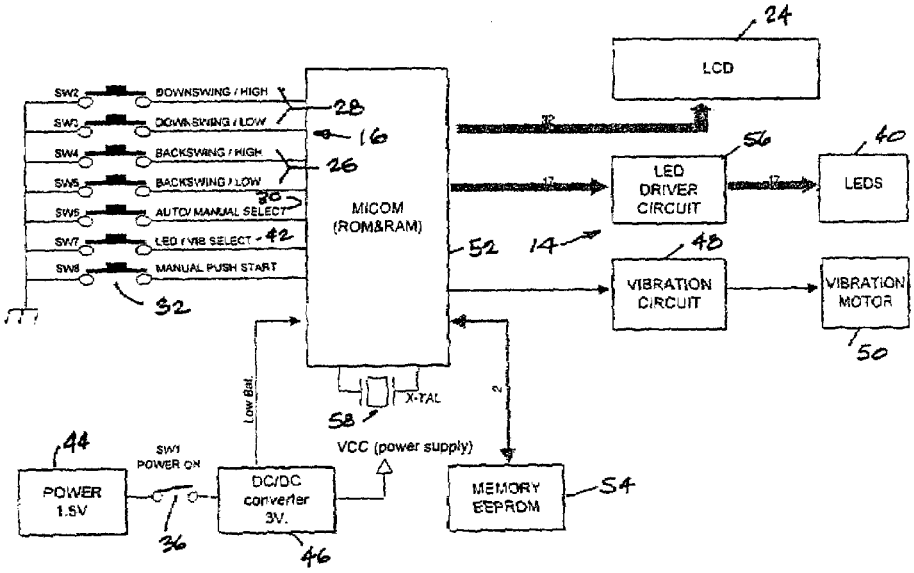
FIG. 3 is a functional block diagram of the golfers aide of FIG. 1.
Figure 5:
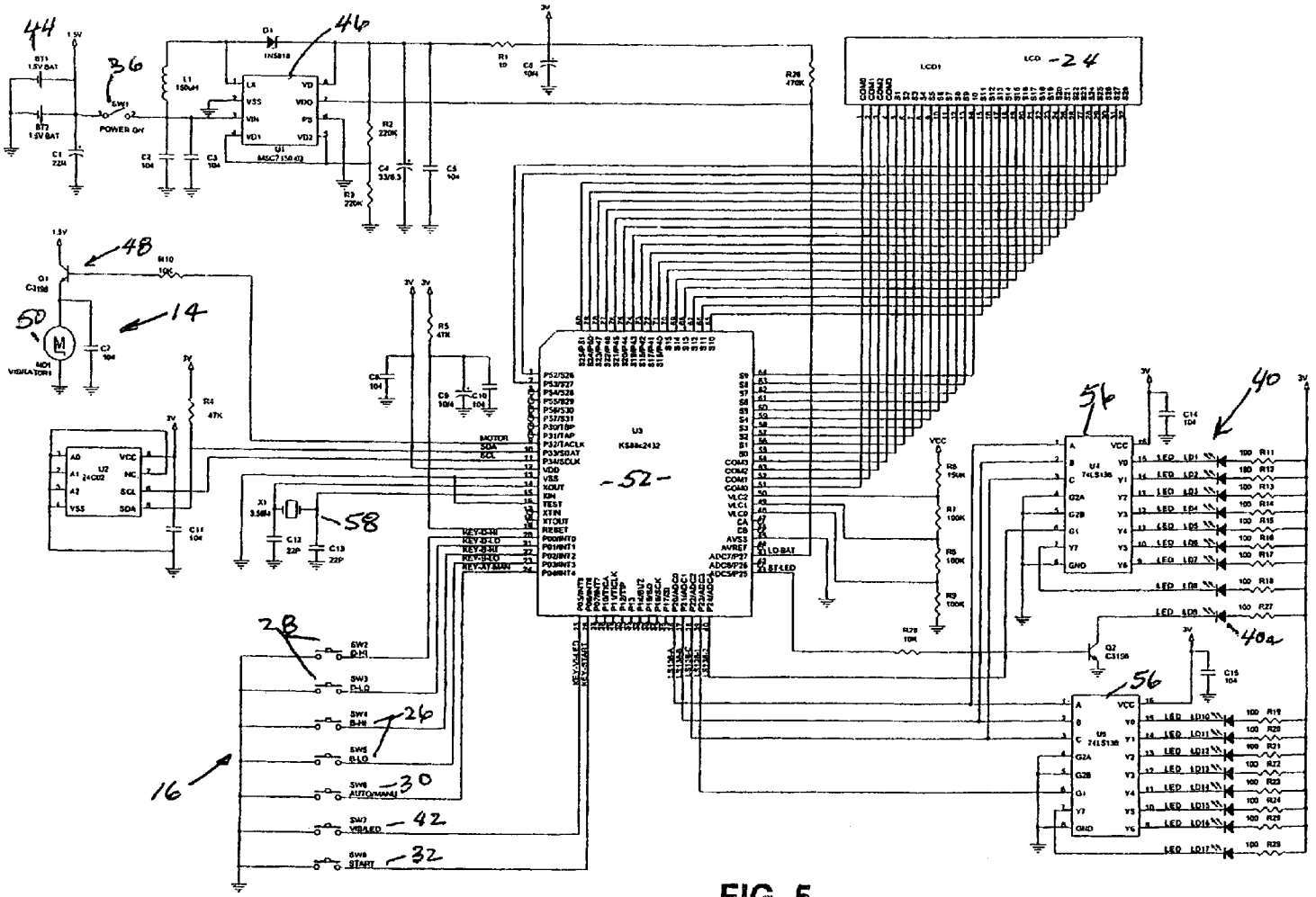
FIG. 5 is a detailed circuit diagram for the golfers aide of FIG. 3.

More specifically as to the first preferred embodiment of the present invention and the block diagram thereof depicted in FIG. 3 and detailed circuit diagram of FIG. 5, the golfers aide 10 is powered by two 1.5 volt AAA batteries 44 which by operation of the power switch 36 and a conventional DC/DC converter 46 develop a 3 volt Vcc supply power for the golfers' aide 10; the converter 46 being depicted in FIG. 5 by the switching regulator U1, part number MSC7150-03 manufactured by OKI. As depicted in FIGS. 3 and 5, the supply power Vcc powers the means 14 including the previously described LCD display 24 and LEDs 40 and a vibration driver 48 and vibration motor 50 as well as MICOM, EEPROM memory and LED driver integrated circuits 52, 54 and 56 respectively. In FIG. 5, the LCD display 24 is labeled LCD1, and may be part number SEQ0363/03(A0) manufactured by Gemini; the LEDs 40 may be conventional LEDs such as those manufactured by UTC; the vibration driver 48 and motor 50 is labeled MO1 and may be part number 3R2.8 manufactured by Shin Kwang; the EEPROM memory integrated circuit 54 is labeled U2, and may be part number 24C02 manufactured by Atmel; the MICOM integrated circuit 52 is labeled U3, and may be part number KS88C2434 manufactured by Samsung; LED driver integrated circuits 56 are labeled U4 and U5, and may be part number 74LS138 manufactured by Fairchild; a crystal oscillator ("XTL") 58 shown in FIG. 3 is labeled in FIG. 5 as X1 and may be a conventional 4 Mhz oscillator manufactured by Sunny. The physical layout of some of these components within the case 12 is depicted in FIG. 2 and the details for implementing the preferred embodiment of the present invention are understood by reference to the detailed circuit diagram of FIG. 5.

Referring to FIG. 3, basically the EEPROM memory 54 stores tables of instructions for the MICOM 52 indicative of various options that the user of the golfers' aide may select in presetting the aide to display a golf club swing tempo preferred by the golfer. The presetting of the golfers' aide 10 is accomplished by the golfer pressing the "up" and "down" buttons of the switches 26 and 28 to control the time duration of the physical vibrations generated by the motor 50 under control of the driver 48 and indicative of the time duration for the back swing and downswing of golfers' club. Such settings are displayed by the LCD display 24 and may also be depicted by the operation of the LEDs 40 under control of the LED driver 56 in the manners previously described.

Figure 6:
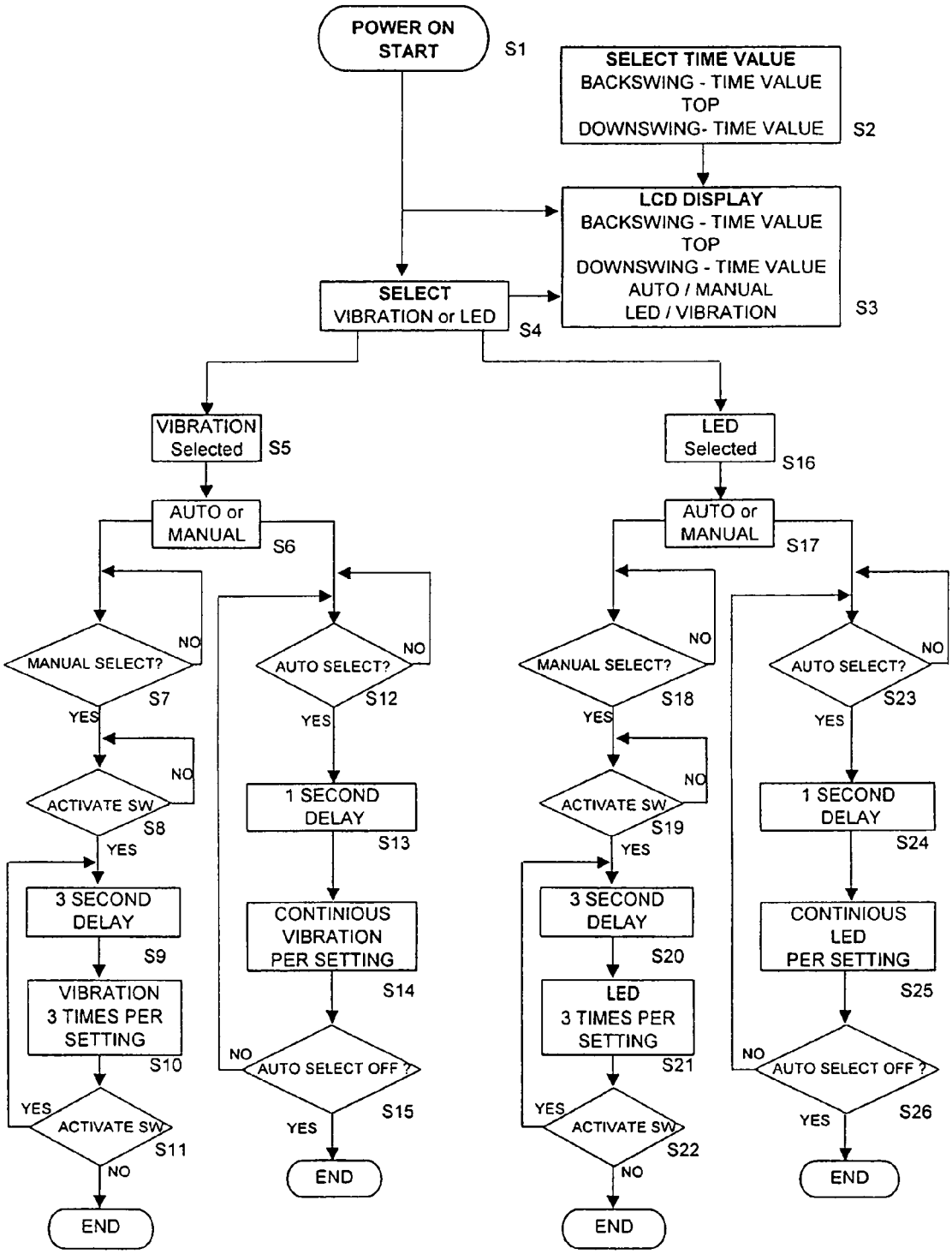
FIG. 6 is a functional flow diagram indicating the various modes of operation of the golfers aide of FIG. 3.

More particularly, the various functional modes of operation of the golfers' aide of the first preferred embodiment of the present invention are depicted in FIG. 6 by the steps labeled S1 through S26. In step S1 the power switch 36 is activated. In step 2 the golfer selects the time values for the back swing and down swing time durations by pressing the "up" and "down" buttons of the switches 26 and 28 respectively. While the settings are being made, the display 24 displays the back swing, upper pause and down swing time durations selected by the golfer in step S3.

In step S4 the golfer selects vibration or LED operation for the golfers' aide by controlling switch 42. If the vibration mode of operation is selected as depicted in step S5, the next step S6 is to select either automatic or manual operation for the golfers' aide by controlling switch 30.

If manual operation is selected as depicted in step S7, operation of switch 32 is required as depicted in step S8. As depicted in the preferred method of operation for the golfers' aide 10 illustrated in FIG. 6, such operation of the switch 32 will introduce a 3 second time delay in step S9 followed by operation of the motor 50 in the manner programmed by the golfer in step S2 to generate low level physical vibration patterns indicative of the preferred swing tempo for the golfer's club. According to the preferred method depicted in FIG. 6, such vibration patterns are repeated three time in step S10 before the golfer is required to activate switch 32 in step S11 to reactivate the manual mode of operation of the golfers' aide 10. Otherwise the manual mode of operation will end.

If automatic mode of operation is selected for the golfers' aide as depicted in step S12, a one second time delay is introduced into operation of the aide 10 in step S13 followed by the continuous vibration patterns in step S14 such as depicted in FIG. 4 and having time durations selected by the golfer by operation of the "up" and "down" buttons of switches 26 and 28 in step S2. At any point in time, the golfer may end continuous vibratory operation of the golfers' aide 10 by setting switch 30 to the manual mode of operation in step S15.

If the LED mode of operation for the golfers' aide 10 is selected in step 4, the aide enters its LED mode as depicted in step S16. Next the golfer can select either manual or automatic modes of operation for the aide as depicted in step S17. If the manual mode is selected by operation of switch 30, the steps of operation depicted by steps S18–S22 conform to those previously described for steps S7–S11. If the automatic mode is selected by operation of the switch 30, the steps of operation depicted by steps S23–S26 conform to those previously described for steps S12–S15. As previously suggested, such LED modes of operation may be useful in assisting the golfer in his or her presetting or resetting of the swing tempo indicated by the golfers' aide 10.

Figure 3A:
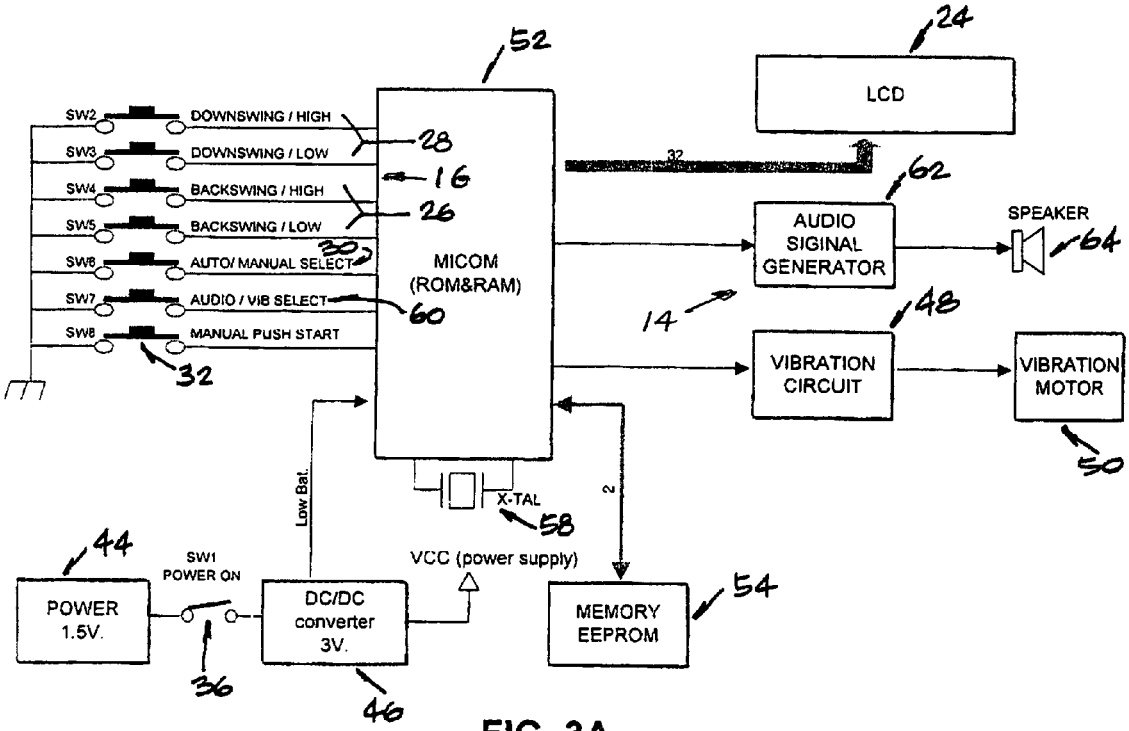
FIG. 3A is a modified version of the functional block diagram of FIG. 3 substituting an audio feature for the LED feature indicated in FIG. 3.

In a modified version of the first embodiment of the present invention as described above, an audible sound feature may be added to the golfers' aide. For the sake of simplicity, in FIG. 3A that sound feature has been added by replacing the LED/VIB switch 42 of FIG. 3 with an Audio/VIB select switch 60 and by replacing LED driver circuit 56 and LEDs 40 with conventional audio signal generator 62 and sound generating speaker 64.

Figure 4A:
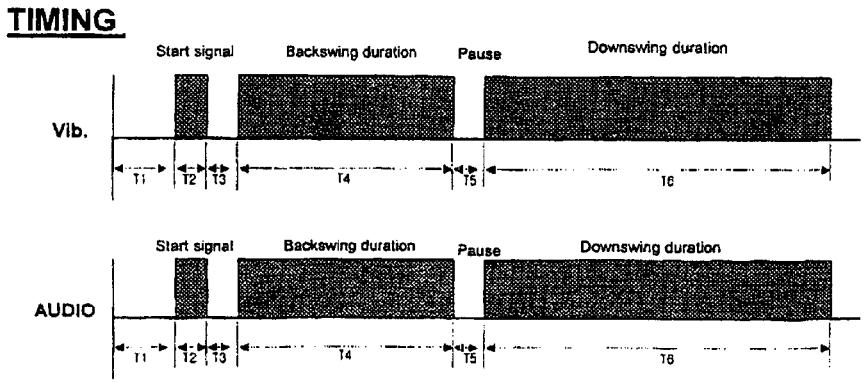
FIG. 4A are timing diagrams of one of the vibration and sound patterns generated by the golfers' aide of FIG. 3A indicative a golfers' preferred golf swing tempo including preferred back swing, upper club pause and downswing time durations.

In the modified version, when the select switch 60 is in the vibration mode, the operation of the golfers' aide 10 is as previously described with reference to FIGS. 3, 4 and 5. When the select switch 60 is in the audio mode, the MICOM 52 of FIG. 3A energizes the audio signal generator 62 to generate a low level high frequency electrical signal having a time duration pattern similar to the audio pattern depicted in FIG. 4A. The electrical signal generated by signal generator 62 is converted by the speaker 64 into a sound pattern as depicted in FIG. 4A comprising a low level "humming" sound corresponding to the preferred swing tempo selected by the golfer by controlling the switches 26 and 28 in the manners previously described.

Figure 7:
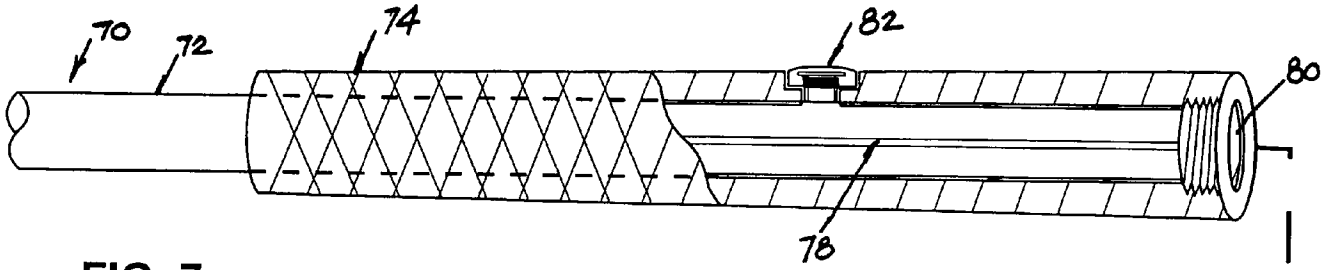
FIG. 7 is an enlarged perspective representation of a circuit board for the second embodiment of the present invention in which the circuit board may be inserted into and removed from a cavity in a grip portion of a golf club.
Figure 8:
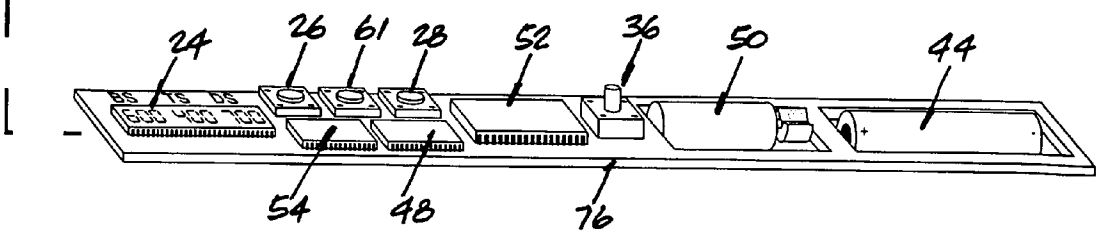
FIG. 8 is an enlarged perspective representation of a circuit board for the second embodiment of the present invention housed in a plastic case that may be inserted into and removed from a cavity in a grip portion of a golf club or which may be carried in the hand of pocket of a golfer.
Figure 8:
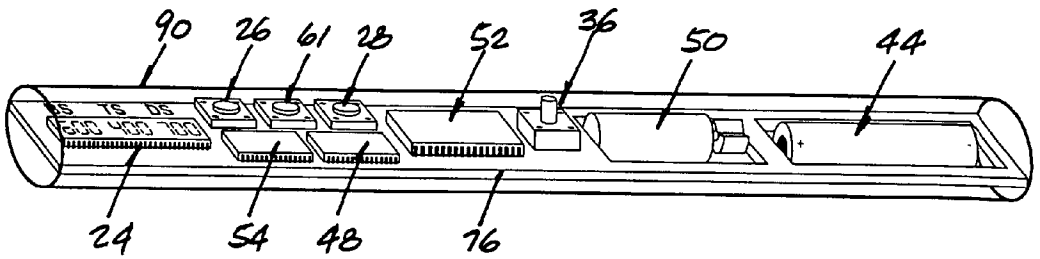
Figure 9:
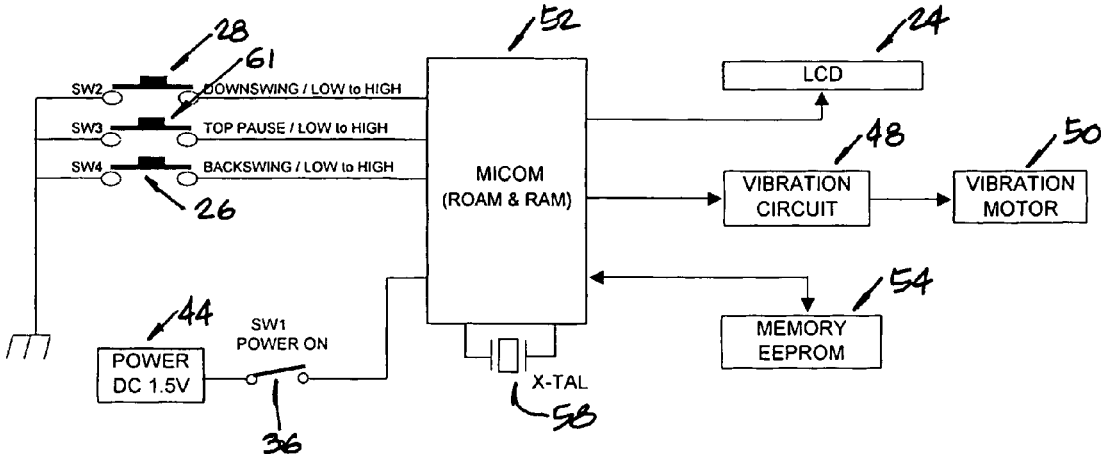
FIG. 9 is a functional block diagram of the golfers' aide comprising the second embodiment of the present invention.
Figure 10:
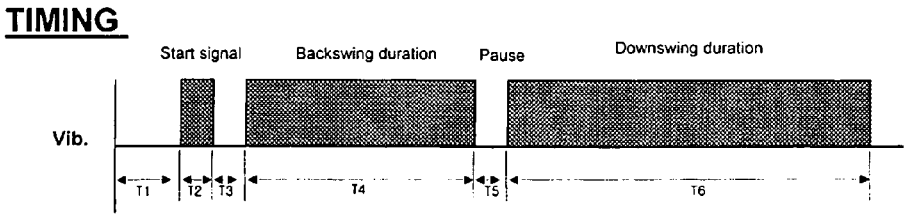
FIG. 10 is a timing diagram of one of the vibration patterns generated by the golfers' aide of FIG. 9.

The second embodiment of the present invention is depicted in FIGS. 7–10. FIGS. 7, 9 and 10 illustrate a simplified version of the first embodiment of the present invention as previously described. The previous description of the components and operation thereof common with the first embodiment should be consulted for a detailed understanding of the second embodiment of the present invention.

As shown in FIG. 7, the circuit board 76 upon which the electrical components of the second embodiment are mounted is insertable into and removable from an axially extending cavity 80 in an end of a grip portion 74 of a shaft 72 of a golf club 70. Once removed from the golf club 70, the circuit board may be inserted into an end cavity 80 of another golf club or placed in a clothing pocket of the golfer to provide means for transferring the physical vibrations generated by the aide 10 to the golfer to assist in maintaining the preferred tempo for the golfers' swing.

With regard to such placement of the board 76, the cavity 80 includes an axially extending slot 78 for receiving and supporting opposite outer marginal edges of the circuit board 76. Once the circuit board 76 is within the cavity 80 an open end of the cavity may be closed, as by a threaded plug (not shown), to seal the golfers' aide 10 within the cavity with the power on-off activation switch 36 thereof in line with a push button 82 carried by the grip portion 74 and extending through the shaft 72. Thus configured, a pressing on the push button 82 will toggle the switch 36 between its "on" and "off" positions to activate the golfers' aide 10 in the manners previously described with regard to FIGS. 3, 5 and 6. In FIG. 7, the physical vibrations and time duration patterns thereof are transmitted from the circuit board 76 through the grip portion 74 of the club 70 to the golfers' hands to indicate to the golfer the preferred tempo for his or her golf club swing.

As depicted in FIG. 9, the golfers' aide of the second embodiment of the present invention is much simpler than the first embodiment illustrated in FIGS. 3 and 5 and includes fewer functional features. For example, the golfers' aide of FIG. 9 only includes the programming switches 26 and 28 for setting the preferred time durations of the back and down swings as previously described and as illustrated in FIG. 10. Also, the options for the programmed time durations selectable by the switches 26 and 28 may be limited, for example to 400, 600, 700, 800 and 1000 units of time.

In addition to the switches 26 and 28, however, the second embodiment of the present invention includes a top pause programming switch 61 to allow the golfer to adjust the time duration of the back swing pause which may be accomplished in the same manner as the previously described golfer setting of the back and/or down swing time durations and as illustrated in FIG. 10.

Such settings of the time durations of the back and down swings and the pause occur prior to mounting the circuit board 76 within the cavity 80. Once the circuit board is mounted within the cavity, the only control of the aide 10 available to the golfer is the activation of the power switch 36 by a pressing of the push button 82. Further adjustment of the aide requires removal of the circuit board 76 from the cavity 80.

To assist in such removal and reinsertion of the circuit board 76 in the cavity 80 as well as to provide a protective covering for the circuit board, it is preferred that the circuit board be housed within a tubular housing or case, such as shown in FIG. 8. As illustrated, the circuit board is enclosed within a tubular plastic case 90. The case 90 may be easily slipped into the cavity 80 and may be conveniently removed and placed in a pocket or hand of a golfer where the physical vibrations generated by the golfers' aide indicative of a preferred swing tempo for the golfer may be easily sensed by the golfer.

While in the foregoing, preferred embodiments of the present invention and preferred modes of operation thereof have been described and illustrated in detail, changes and modifications may be made without departing from the spirit of the present invention. For example, in the foregoing descriptions, the term "golf club" should be understood to include a "putter". Also, with respect to the simplified second embodiment of the present invention, the golfers aide may be placed within the grip portion of the golf club or putter or carried in the hand or pocket of a golfer or may be attached to the outside of a golf club or putter as by the use of an attaching means such as a "Velcro" fastener or other suitable means. The important feature in these regards is that the aide be placed such that the physical vibrations generated thereby are felt by the golfer and function as a guide in maintaining a preferred swing tempo for the golfer. Further, the activation switch for the aide may be supported on other parts or end of the grip portion and may connect various types of batteries e.g. a watch battery, to power the other circuit components of the aide. Accordingly the present invention is to be limited in scope only by the following claims.

The invention claimed is:

1. An aide for assisting a golfer in swinging a golf club with a preferred and consistent tempo, comprising:

a programmable physical vibration generating means for generating low level physical vibration patterns having user independently adjustable time duration components corresponding to (i) a time duration for a back swing of a golf club followed by a vibration pause of a time duration corresponding to a pause at the top of the back swing of the golf club and (ii) a time duration for a down swing of the golf club;

first user operable switch means in circuit with the physical vibration generating means for independently and selectively increasing or decreasing the time duration of the component of the vibration pattern generated by the physical vibration generating means corresponding to the back swing of the golf club;

second user operable switch means in circuit with the physical vibration generating means for independently and selectively increasing or decreasing the time duration of the component of the vibration pattern generated by the physical vibration generating means corresponding to the down swing of the golf club; and housing means for supporting the physical vibration generating means and for transmitting the physical vibration patterns to the golfer for sensing by a golfer as a preferred swing tempo for the golf club.

2. The aide of claim 1 further comprising:

third user operable switch means in circuit with the physical vibration generating means for independently and selectively increasing or decreasing the time duration of the component of the vibration pattern generated by the physical vibration generating means corresponding to the pause in the physical vibrations at the top of the back swing of the golf club.

3. The aide of claim 1 further comprising a visual display means in circuit with the physical vibration generating means for displaying the time durations of the back swing, pause and downswing components of the vibration patterns programmed into the physical vibration generating means.

4. The aide of claim 1 further comprising a semicircular array of light sources responsive to the user operable switch means for lighting in a sequence visually displaying the swing tempo for the golf club selected by user operation of the switch means.

5. The aide of claim 4 further comprising user operable means for activating either the array of light sources or the means for generating the vibration patterns.

6. The aide of claim 1 wherein the means for generating the vibration patterns comprises electromechanical means including a motor.

7. The aide of claim 6 further comprising a visual display means for displaying time durations of the vibration components of the vibration patterns generated by the physical vibration generating means.

8. The aide of claim 1 wherein the physical vibration generating means comprises a component support plate and the housing comprises a cavity in an end of the grip portion of the golf club for axially receiving the support plate with an activation switch mounted on the support plate for operation by the golfer.

9. The aide of claim 1 wherein the housing comprises a tubular case.

10. The aide of claim 9 wherein the case is mountable within a cavity in a hand-grip portion of one or more golf clubs.

11. An aide for assisting a golfer in swinging a golf club with a preferred and consistent tempo, comprising:

programmable physical vibration generating means for generating low level physical vibration patterns having time duration components corresponding to (i) a time duration for a back swing of a golf club followed by (ii) a vibration pause of a time duration corresponding to a pause at the top of the back swing of the golf club and (ii) a time duration for a down swing of the golf club;

switch means in circuit with the physical vibration generating means for selectively modifying the vibration pattern generated by the physical vibration generating means; and housing means for supporting the physical vibration generating means and for transmitting the physical vibration patterns to the golfer for sensing by a golfer as a preferred swing tempo for the golf club.

* * * * *